US005785496A

United States Patent [19]

Tomita

[11] Patent Number: 5,785,496

[45] Date of Patent: Jul. 28, 1998

[54] GAS TURBINE ROTOR

[75] Inventor: Yasuoki Tomita, Takasago, Japan

[73] Assignee: Mitsubishi Heavy Industries, Ltd., Tokyo, Japan

[21] Appl. No.: 803,771

[22] Filed: Feb. 24, 1997

[51] Int. Cl.[6] ..... F01D 5/18

[52] U.S. Cl. ..... 416/97 R; 416/191; 416/192

[58] Field of Search ..... 415/115, 116; 416/96 R, 96 A, 97 R, 97 A, 190, 191, 192

[56] References Cited

U.S. PATENT DOCUMENTS

| | | | |
|---|---|---|---|
| 1,651,503 | 12/1927 | Belluzzo | 416/96 R |
| 4,940,388 | 7/1990 | Lilleker et al. | 416/97 R |
| 4,948,338 | 8/1990 | Wickerson | 416/190 |
| 5,460,486 | 10/1995 | Evans et al. | 416/97 R |
| 5,482,435 | 1/1996 | Dorris et al. | 416/97 R |
| 5,531,568 | 7/1996 | Broadhead | 416/97 R |

FOREIGN PATENT DOCUMENTS

| | | | |
|---|---|---|---|
| 58-47104 | 3/1983 | Japan | 416/97 R |
| 2-221602 | 9/1990 | Japan | 416/97 R |
| 2132703 | 7/1984 | United Kingdom | 416/97 R |

*Primary Examiner*—Christopher Verdier
*Attorney, Agent, or Firm*—Wenderoth, Lind & Ponack, L.L.P.

[57] ABSTRACT

A gas turbine rotor blade includes a shroud which is cooled effectively with cooling gas used for cooling the blade profile so that the temperature of the shroud is reduced and the life of the gas turbine rotor blade is extended. A two-step groove is engraved in the shroud along the tip of the blade profile and the upper portion of the two-step groove is plugged. Second cooling holes are bored along the direction of the plane of the shroud so as to be connected to and communicate with the first cooling holes which are bored in the blade profile in a direction along the longitudinal axis of the blade for passing cooling gas through the blade. Consequently, most of the cooling gas, after cooling the blade profile, can be used for cooling the shroud, so that the shroud is cooled effectively and the temperature thereof is prevented from rising. Preventing the temperature from rising can also prevent reduction of the creep resistance of the shroud and prevent the blade root on the shroud from being turned up.

6 Claims, 2 Drawing Sheets

GAS TURBINE ROTOR

BACKGROUND OF THE INVENTION

The present invention relates to a thin walled, long, and large gas turbine rotor blade to be installed in a rear position of a gas turbine blade array, which is cooled with cool air circulating inside the blade. This rotor blade is used for thermal power generation, etc.

FIGS. 2(*a*) and 2(*b*) show a rotor blade of a gas turbine, which is called an integral shroud blade, used for thermal power generation, etc. At the tip of the rotor blade 11 a shroud 12 is integrally formed with the rotor blade 11. The shroud 12 functions to reduce the amount of working gas leaking from the tip of the rotor blade 11 in the direction of the blade axis. Furthermore, since the end face of the shroud 12 is pressure-welded to the end face of another adjacent shroud to form a series of group blades, the shroud 12 also functions to improve the vibration resistance of the rotor blade 11. Vibration generated in such a rotor blade 11 is classified into two types; vibration generated in the axial direction, and vibration generated in the circumferential direction of the rotor blade 11 during rotation. Also, both of the vibrations can be controlled by forming the side face of the shroud 12 obliquely with respect to the tip of the rotor blade 11. Fins 13 are provided on the surface of the shroud 12, and each of the fins protrudes from the surface of the shroud 12 so as to reduce the amount of working gas leaking from the tip of the rotor blade 11 in the rotary axis direction and to prevent the upper surface of the shroud 12 from contacting the casing.

The gas turbine rotor blade 11 is also provided with various cooling means to cope with the high temperature of working gas. If the inlet temperature of the gas turbine reaches 1000° to 1200° C., convection cooling of the rotor blades, to be carried out through a plurality of holes 14, is generally adopted. The arrows in FIG. 2(*b*) indicate the flow of cooling air circulating in such a rotor blade 11.

The cooling air whose temperature rises due to the convection cooling through the holes 14 throughout the blade profile of rotor blade 11 is discharged into the working gas from the holes 14. Thus, the cooling effect at an upper portion of the rotor blade 11 is reduced. Also, this cooling method is not usually applied to the shroud 12 which is integrated with the rotor blade 11. Thus, the shroud 12, whose size continues to increase, is subjected to the elevated temperatures which results in deterioration of the creep resistance. As a result, the root of the shroud 12 is turned up by centrifugal force thereby increasing the stress at that part of the shroud, which often results in breaking.

The object of this invention is to solve the above problems of the prior art gas turbine rotor blades by improving the cooling effect on each shroud integrated with a rotor blade and to lower the temperature of the shroud in order to prevent creep strength deterioration and avoid breaking of the shroud so as to achieve a long life gas turbine rotor blade.

SUMMARY OF THE INVENTION

In order to achieve the above object, the gas turbine rotor of this invention adopts the following configuration.

The blade profile of each rotor blade comprises a plurality of first cooling holes bored in a blade profile in the blade axis length direction for passing cooling gas. Also, a plurality of second cooling holes are bored in a shroud in the direction along the plane of the shroud so as to communicate with the first cooling holes for passing cooling gas.

Consequently, in the gas turbine rotor blade of this invention, a plurality of the first cooling holes bored in the blade profile along the blade axis length direction are communicated with the second cooling holes bored in the shroud in the direction along the plane thereof. Thus, most of the cooling gas supplied through the first cooling holes for cooling the blade profile is passed through the second cooling holes for cooling the shroud, thereby effectively lowering the temperature inside of the shroud. This is very effective to suppress rising of the shroud temperature and deterioration of the shroud strength due to the high temperature, as well as to prevent the shroud from damage, etc. caused by the increasing stress on the root of the shroud, which is often turned up by a centrifugal force when the shroud's creep resistance has deteriorated.

Furthermore, the gas turbine rotor blade of this invention comprises a plurality of the first cooling holes bored in the rotor blade profile in the longitudinal direction of the blade, and a plurality of the second cooling holes bored in the shroud in the direction along the plane thereof so that both first and second cooling holes communicate with each other for passing cooling gas. The blade is further provided with a two-step groove engraved on the shroud along the tip of the blade profile. The two-step groove has an upper step portion which is plugged and a lower step portion through which the first cooling holes communicate with the second cooling holes.

Consequently, the gas turbine rotor blade of this invention can prevent the shroud from damage and provide a long life gas turbine rotor as described above.

In addition, since the first cooling holes communicate with the second cooling holes through the two-step groove which is engraved in the shroud along the tip of the blade profile, the second cooling holes are bored toward the groove and then the upper step portion of the groove is plugged. This makes it easier to engrave the groove and bore the second cooling holes.

BRIEF DESCRIPTION OF THE DRAWINGS

Embodiments of the present invention will be described with reference to the attached drawings.

FIG. 1(*b*) is a cross sectional view taken along line 1B—1B in FIG. 1(*a*). FIG. 1(*c*) is an enlarged view of a plug provided in a two-step groove shown in FIG. 1*b*.

FIG. 2(*b*) is a top view taken along line 2B—2B in FIG. 2(*a*).

DETAILED DESCRIPTION OF THE PREFERRED EMBODIMENTS

Figure 1A:
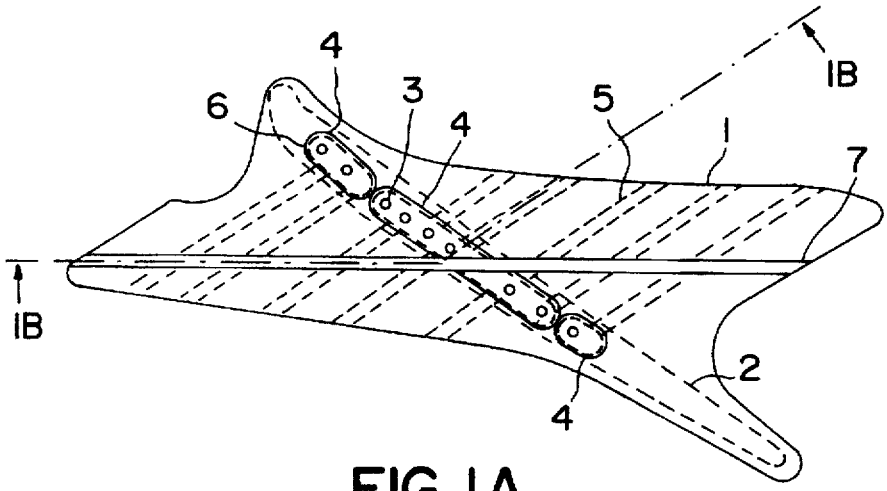
FIG. 1(*a*) is a top view of an embodiment of a gas turbine rotor blade according to the present invention.
Figure 1B:
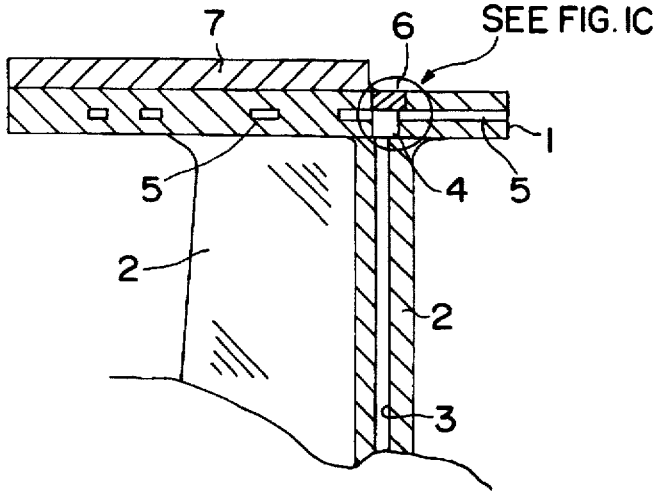
Figure 1C:
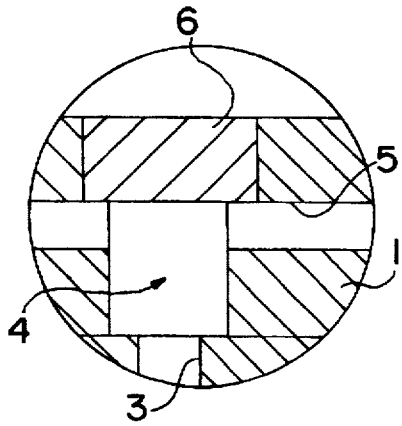
Figure 2A:
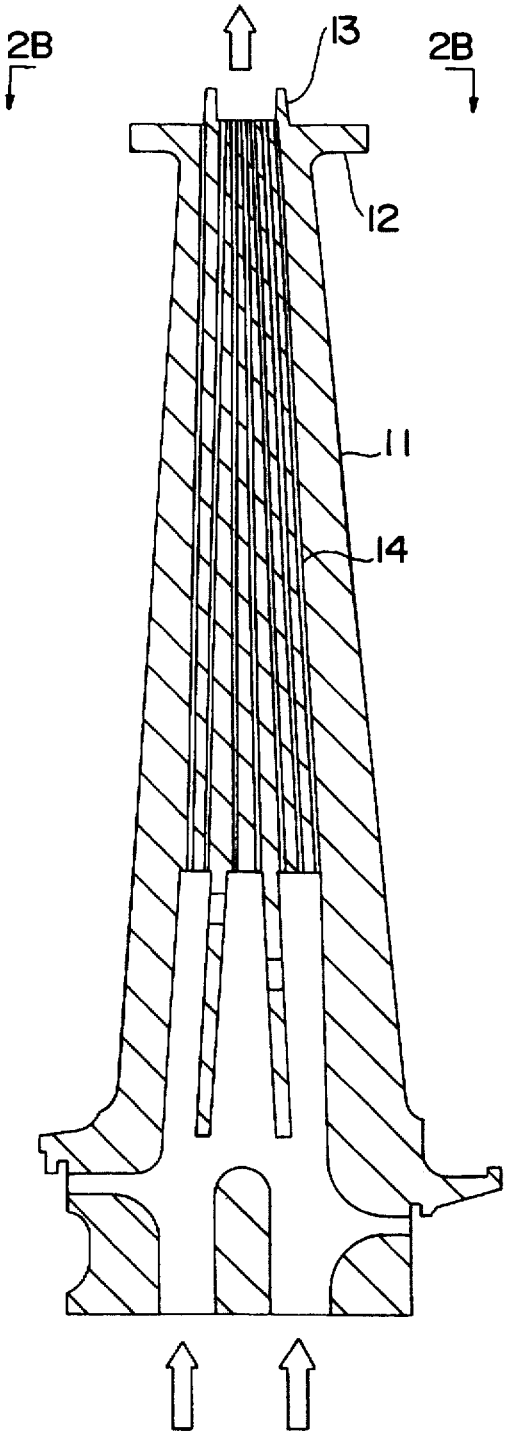
FIG. 2A PRIOR ART
FIG. 2(*a*) is a cross sectional view of the prior art gas turbine rotor blade taken along the direction of the center of the blade thickness.
Figure 2B:
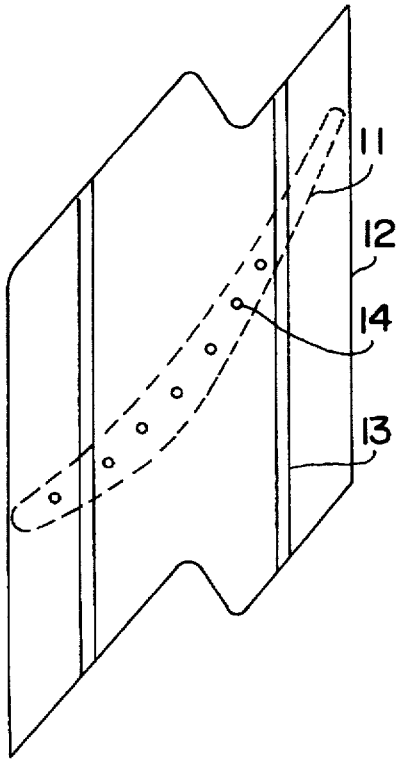
FIG. 2B PRIOR ART

In a gas turbine rotor blade described in a first embodiment of this invention, which is called an integral shroud blade and used for thermal power generation, etc., the integral shroud 1 is integrated with a blade profile 2 at the tip of the blade-formed blade profile. The shroud 1 functions to reduce the amount of gas leaking from the tip of the blade profile 2 in a longitudinal direction of the blade, which is the radial direction of the blade profile. Furthermore, the end face of the shroud 1 is pressure-welded to the end face of another adjacent shroud 1 to form a series of group blades so as to improve the vibrational resistance of the blade profile 2. The blade profile 2 generates vibrations in two directions, i.e. vibration in the rotating axis direction and vibration in the circumferential direction of the blade profile shaft. However, vibrations in both directions can be controlled by forming the side face of the shroud 1 obliquely to the blade edge of the blade profile 2. Furthermore, a fin 7 protrudes from an upper surface of the shroud 1 to reduce the amount of gas leaking from the tip of the blade profile 2 in a longitudinal axial direction of the rotor and to prevent the shroud surface from contacting the casing.

In order to cope with high temperature gas in the blade profile, this gas turbine adopts convection cooling carried out through a plurality of cooling holes 3 (first cooling holes). Furthermore, the wall of the shroud 1 is thin and the shape is formed like a ray fish. The shroud 1 is also provided with a two-step groove 4 formed or engraved in a radial outer surface generally along the tip of the blade profile 2 and communicating with the cooling holes 3. A plurality of cooling holes 5 constituting second cooling holes for cooling the shroud 1 are bored from an edge of the shroud 1 toward the two-step groove. When boring the holes 5 on the shroud 1, the two-step groove 4 is engraved on the shroud 1 along the outlet of the cooling holes 3 of the blade profile 2, then cooling holes 5 are bored toward the two-step groove in the shroud 1. After this, the upper portion of the two-step groove 4 is covered with a plug 6. This plug 6 is fit in the upper portion of the two-step groove 4 so as not to block the cooling holes 5 of the shroud 1, then welded at its periphery to the shroud 1.

Cooling air flows through the cooling holes 3 to cool the blade profile 2, then goes into the cooling holes 5 for convection cooling of the shroud 1, then the air is discharged into the working gas from the edge of the shroud 1. Since the cooling holes 3 of the blade profile 2 communicate with the cooling holes 5 of the shroud 1, the cooling air can be used effectively. Furthermore, since the two-step groove 4 is engraved in the shroud 1, boring of the cooling holes 5 for the shroud 1 is easy. Unlike the prior art gas turbine rotor blade, the shroud 1 of the rotor blade is not formed like a ring having a fixed width, but is formed with part of the ring removed. However, this does not present a problem because only the weight of the shroud 1 is reduced. The vibrational resistance of the blade profile 2 can be sufficiently compensated since the shroud 1 is connected to another adjacent shroud with their contact surfaces. Furthermore, since a fin 7 is provided so as to pass through the center of the tip of the blade profile 2, to which the shroud 1 is connected without any chipping on the circumference, it can function well enough to prevent leaking gas.

The prior art gas turbine rotor blade adopts convection cooling carried out through many holes. Cooling air whose temperature rises after cooling the rotor blade is also used for cooling the surface of the rotor blade before being discharged from those holes. Thus, the cooling effect on the surface of each rotor blade is reduced, and the shroud is not cooled at all. Since shrouds are recently becoming larger and larger in size, such a low cooling effect will cause the root of the shroud to be turned up by a centrifugal force, and therefore the stress on that part increases, resulting in breaking. The gas turbine rotor of this invention, however, has solved the problem by thinning the wall of the shroud 1, forming the top surface like a ray fish, engraving a two-step groove along the outlet of the cooling holes 3 of the blade profile beginning at the end face of the shroud 1, and boring the cooling holes 5 in the shroud 1 so as to be connected to the two-step groove so that cooling holes 3 are connected to cooling holes 5 via the two-step groove. The upper portion of the two-step groove 4 is covered with a plug 6 in such a manner so as to not obstruct the cooling holes 5. Since the weight of the shroud 1 is reduced, the turning-up stress, which works on the root of the shroud 1, is significantly reduced, thus extending the life of the rotor blade. Furthermore, since cooling gas passing the cooling holes 3 of the blade profile 2 is discharged from the cooling holes 5 of the shroud 1, the shroud 1 is also cooled by the cooling air. Thus, the temperature of the shroud 1 is reduced so as to extend further the life of the rotor blade. Also, since a two-step groove 4 is already engraved along the outlet of the cooling holes 3 of the blade profile 2 before cooling holes 5 are bored in the shroud 1, it is only needed to bore cooling holes 5 in the shroud 1 toward the two-step groove. This makes it easier to bore cooling holes 5. Cooling air can also be used effectively in this embodiment by using plug 6 to cover the upper portion of the two-step groove, which is at the outlet of the cooling holes 3 of the blade profile.

What is claimed is:

1. A gas turbine blade assembly comprising:

a blade having a tip portion;

a plurality of first cooling holes bored in said blade along a longitudinal direction of said blade for passing cooling gas therethrough;

a shroud connected to said tip portion of said blade;

a two-step groove formed in a radially outer peripheral surface of said shroud, said two-step groove being generally aligned with said tip portion of said blade;

a plurality of second cooling holes bored in said shroud along a plane of said shroud, said second cooling holes fluidly communicating with said first cooling holes via said two-step groove; and a plug disposed in an upper portion of said two-step groove.

2. The gas turbine blade assembly as claimed in claim 1, wherein said two-stepped groove has a first portion and a second portion, said first portion being located radially outwardly of said second portion, and said first portion being wider than said second portion so as to form surfaces upon which said plug is received.

3. The gas turbine assembly as claimed in claim 2, wherein said plug is disposed radially outwardly of said second cooling holes, and said second portion of said two-step groove is transverse relative to said second cooling holes.

4. A gas turbine blade assembly comprising:

a blade having a tip portion;

a plurality of first cooling holes bored in said blade along a longitudinal direction of said blade for passing cooling gas therethrough;

a shroud connected to said tip portion of said blade, said shroud having a radial inner peripheral surface and a radial outer peripheral surface;

a groove formed in said radial outer peripheral surface of said shroud and communicating with said first cooling holes;

a plurality of second cooling holes disposed between said radial inner peripheral surface and said radial outer peripheral surface of said shroud, said second cooling holes fluidly communicating with said groove; and a plug disposed in said groove to block flow of cooling gas through said radial outer peripheral surface of said shroud and permit flow of cooling gas from said first cooling holes through said second cooling holes.

5. The gas turbine blade assembly as claimed in claim 4, wherein said groove comprises a two-stepped groove.

6. The gas turbine assembly as claimed in claim 4, wherein said groove has an outer width and an inner width, and said outer width is greater than said inner width.

* * * * *